United States Patent [19]

Ohnmacht et al.

[11] 4,357,521

[45] Nov. 2, 1982

[54] ELECTRICAL HEATING DEVICE FOR FLUID MEDIA

[75] Inventors: Helmut Ohnmacht; Klaus Meywald, both of Kandel, Fed. Rep. of Germany

[73] Assignee: Firma Fritz Eichenauer, Kandel, Fed. Rep. of Germany

[21] Appl. No.: 56,944

[22] Filed: Jul. 12, 1979

[30] Foreign Application Priority Data

Jul. 12, 1978 [DE] Fed. Rep. of Germany ..... 2830532

[51] Int. Cl.[3] ..... H05B 3/02

[52] U.S. Cl. ..... 219/375; 219/370; 219/376

[58] Field of Search ..... 219/370–376, 219/368–370, 380–382

[56] References Cited

U.S. PATENT DOCUMENTS 4,230,933 10/1980 Glucksman et al. ..... 219/375

FOREIGN PATENT DOCUMENTS 197808 4/1971 Fed. Rep. of Germany ..... 219/375
2015628 10/1971 Fed. Rep. of Germany ..... 219/375
2349888 4/1975 Fed. Rep. of Germany ..... 219/370
2727940 12/1977 Fed. Rep. of Germany ..... 219/370
2722213 11/1978 Fed. Rep. of Germany ..... 219/375

*Primary Examiner*—Bernard Roskoski
*Attorney, Agent, or Firm*—Paul M. Craig, Jr.

[57] ABSTRACT

A form of electrical heating device, which is particularly applicable to hair driers but may also be useful in fan heaters or other electrical heaters for gaseous or other fluid media, comprises an insulating support plate around which a resistance heating wire is helically coiled with neighbouring turns of the coil offset to achieve improved heat exchange to the medium flowing over it and while allowing the device to be produced inexpensively and in a simple and trouble-free manner. The centers of the respective groups of turns which are similarly offset may lie on parallel lines or lines which converge along the length of the device. There may be two such groups or more, four for example. The turns are located in suitably dimensioned slots in the edges of the support plate; the wire may be bent into meander or sinuous form, in which case it can be made to grip the support plate in the region of the slots. A second support plate may be provided, to form a cruciform support, in order to improve the stability of the heater winding, the slots in the second plate also being dimensioned to suit the positions of the turns.

14 Claims, 6 Drawing Figures

ELECTRICAL HEATING DEVICE FOR FLUID MEDIA

Figure 1:
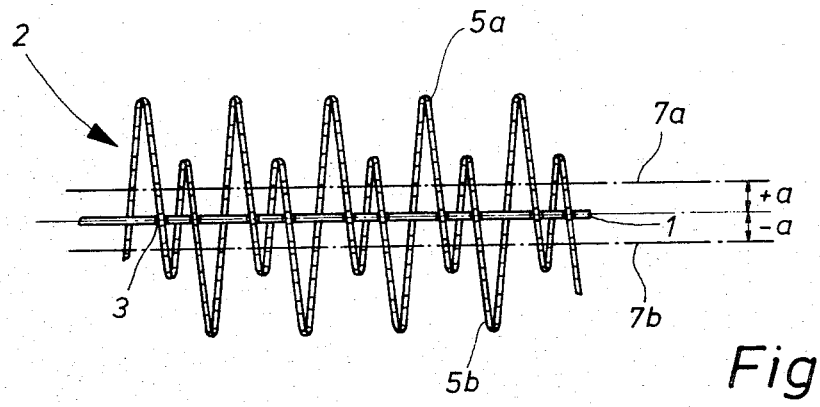

The invention relates to an electrical heating device for fluid, more particularly gaseous media, of the kind comprising a support plate of insulating material and a heating conductor of resistance wire which is arranged about the support plate with spacing, the heating conductor being formed as a helical coil and located in edge indentations of the support plate.

Such heating devices are used in various constructional forms, more especially in electrical hot air appliances (hair driers, fan heaters etc.). The resistance wire is given a round or rectangular cross-section depending on the power consumption, desired temperature etc., and is wound as a helical coil about the support plate, which is itself mounted in the appliance housing. The support plate is often made flat, but may also be built up cross-shaped in which case it may be constituted by two plates fitted into one another. To secure the turns of the coil in position the support plate is provided with edge incisions or indentations in which the heating conductor is fixed. The cross-sectional form of the turns is to a large extent optional but usually longitudinally or transversely oval or circular and in any case so formed that the turns lie freely in the throughflowing medium.

In a known electrical heating device of the kind specified (cf. German published specification No. 25 30 075) the turns of the heating conductor are made identical as regards cross-sectional size and form over the entire length of the heating device, so that they lie on the generated surface of a cylinder. In the usual arrangement, wherein the longitudinal axis of the heating device is situated parallel to the flow direction, this has the result that turns which are situated downstream are washed by already heated medium and that medium flowing inside and outside the cylindrical structure formed by the turns is heated to only an inadequate extent. Thus in the case of that known constructional form the result is an unsatisfactory heat exchange between the heating conductor and the medium.

According to the present invention, in an electrical heating device of the kind initially specified, neighbouring turns of the coil are offset relatively to one another in a direction perpendicular to the plane of the support plate. This results in improved heat exchange while allowing the heating device to be produced inexpensively and in a simple and trouble-free manner.

Whereas in the known constructional form the turns are situated on a cylinder on the central plane of which the support plate is situated, the invention proposes that the turns are arranged eccentrically in a way which will be explained hereinafter and at any rate differently from one another relatively to the support plate in a direction perpendicular to the said plate. In this way the result is achieved that—in projection on to a plane perpendicular to the longitudinal axis of the helix—the turns are disposed in different cross-sectional regions. Alignment of all the turns occurs at the most at the edge of the support plate, if the edge indentations in which the turns are fixed have the same depth. If a cross-shaped support is used, of course one of its arms must have indentations of different depths in accordance with the course of the turns.

If the position of a turn is defined by its turn centre (which may correspond for example to the centre point of the area of the turn cross-section) according to the invention the turn centres are not all situated one behind the other in the longitudinal direction, and more particularly not all in the support plate as in the case of the known constructional form. A completely statistical position for the turn centres, which is difficult to achieve from the production technique point of view, is usually not necessary. Satisfactory results are obtained if the centre of each turn is situated in one of a plurality of different predetermined positions and turns with the same centre position have substantially the same turn cross-section. By a plurality of positions is meant a number which at all events is considerably smaller than the total number of turns and is of the order of magnitude of two to four.

Preferably a symmetrical construction is chosen wherein the turn centres are at the same spacing from the support plate above and below the said plate. With such a construction, a corresponding number of turn groups is obtained, these extending through different cross-section regions and having the turns staggered one behind the other in the longitudinal direction.

A constructional form which is easy to manage from the production point of view, and gives a particularly uniform heat exchange over the length of the heating device, is such that the positions of the turn centres vary periodically along the longitudinal axis of the helix. Under these circumstances it is particularly advantageous to use a constructional form wherein the turn centres are situated alternately above and below the support plate, and thus wherein there are only two different positions for the turn centres.

If the edge indentations of the support plate are all in alignment with one another, it is possible to achieve exact identity of turn cross-sections only for two positions of the turn centres (symmetrical positions with respect to the support plate). If three such positions (in which case the centre position will be situated in the support plate) or more than three are provided, turn cross-section shapes which differ to a certain extent occur. In order to obviate this, it is proposed that turns whose centres are at different spacings from the support plate are fixed in edge indentations of different depth. In this way it is possible to take into account the different lengths of chord between the fixing points on the support plate. In general a heating device according to the present invention will usually be of symmetrical construction as regards the support plate and with respect to its own longitudinal central plane.

In the foregoing it has been assumed that the turn centres of each individual turn group have the same spacing from the support plate. (By "turn group" is meant those of the turns whose centres are similarly situated.). A further improvement in heat exchange can be achieved by arranging the centres of the turns in each turn group to converge, along the longitudinal axis of the helix, towards the support plate. Thus, with the preferable symmetrical constructional arrangement, there is a convergence towards one another above and below the support plate of at least those turn centres which are situated with similar spacing from the support plate. This converging pattern is superimposed on the variation in turn centre positions from turn to turn. This arrangement makes it possible for all turns to be freely exposed to the throughflowing medium, without masking one another, and to achieve an optimum uniform dissipation of heat over the cross-section. This gives a particular advantage, from the constructional point of view, for mounting in an appliance, in that such a heating device can be so constructed that it has a cylindrical geometric envelope. A further advantage of the constructional forms described is that the turns are to a large extent identical as regards cross-section and turn length, so that the load of the turns and the heat transfer to the medium are substantially constant over the length of the heating device.

If a constant turn cross-section is not required, there is the further advantageous possibility, with turn centres converging in the longitudinal directions, of so dimensioning the turns of two different turn groups that between the turn tips of the different turn groups there is a constant spacing. This affords the possibility of adjusting the heat discharge over the cross-section in a particular way.

In a heating device according to the invention the support plate is not situated in the central plane of greatest width of the turns, and therefore it is necessary to provide fixing in the direction perpendicular to the plate plane, so that the support plates do not fall out of the helix. This can be effected by providing that the turns comprise, in the region of abutment on the support plate, bent-over portions which engage about the support plate (cf. German published specification No. 18 05 639). But this facility involves relatively considerable outlay as regards manufacture. Therefore, for fixing the turns it is advisable to use a per se known arrangement (c.f. German laid-open specification No. 26 44 093) wherein the heating conductor consists of resistance wire bent to a meander or sinuously coiled form and the support plate is held in a meander bend in the region of the edge indentations in each case. Moreover, use can be made of the possibility of providing voltage taps by means of pushed-on spring clips.

The advantages achieved by the invention consist above all in that an electrical heating device is provided which can be produced in a simple and trouble-free manner and ensures uniform effective heat exchange between heating conductor and throughflowing medium. It is regarded as particularly advantageous that the arrangement of the heating conductor in accordance with the present invention contributes at the same time to an improvement in the flow conditions in the sense of making the flow more uniform.

Figure 2:
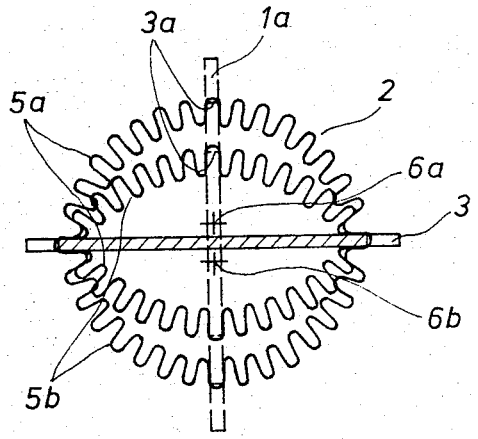
Figure 3:
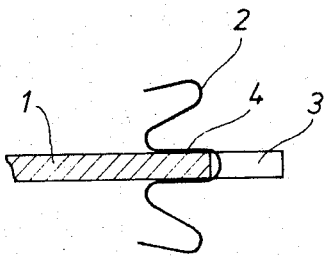
Figure 4:
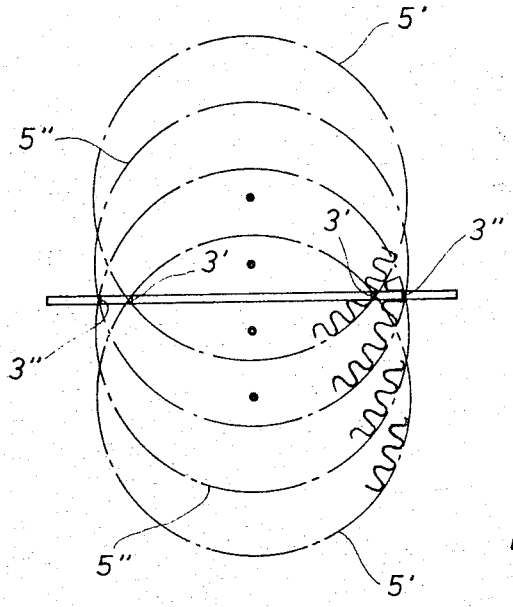
Figure 5:
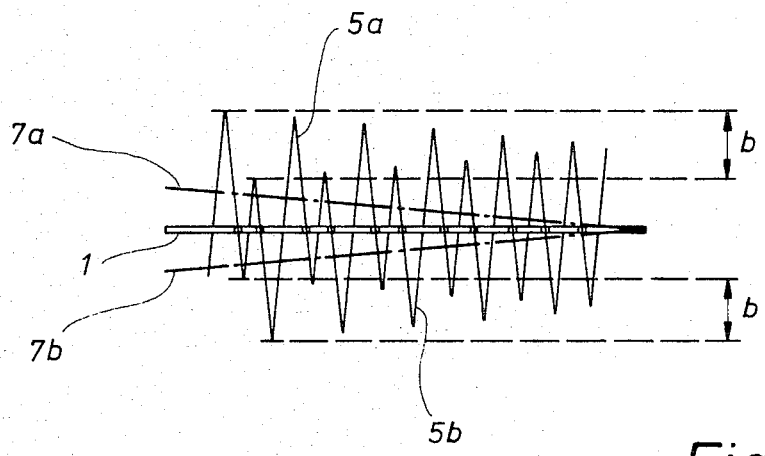
Figure 6:
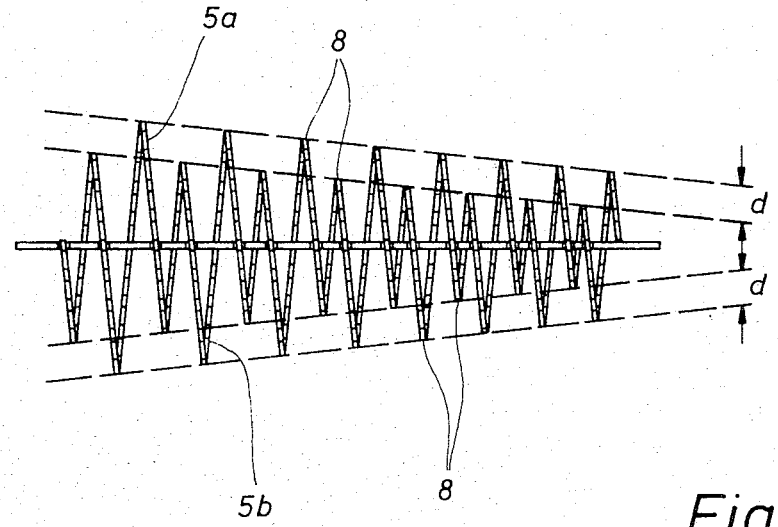

The invention will be described in more detail hereinafter with reference to drawings which show constructional examples and in which:

FIG. 1 is a side view of an electrical heating device for gaseous fluid media, FIG. 2 shows the subject of FIG. 1 in cross-section, FIG. 3 shows a fragment of FIG. 2 on an enlarged scale, FIG. 4 shows another constructional form of the subject of FIG. 2 in a simplified representation, FIG. 5 shows another constructional form of the subject of FIG. 1 in a simplified representation, FIG. 6 shows another constructional form of the subject of FIG. 1 in a simplified representation.

The electrical heating device shown in FIG. 1 is intended for a hot air appliance, namely a hair drier, and consists as regards its basic construction of a support plate 1 of insulating material and a heating conductor 2 of resistance wire of rectangular cross-section. The heating conductor 2 is wound in the form of a helix about the support plate 1 and fixed in edge indentations or slots 3 of the support plate 1. As can be seen more expecially with the help of FIG. 3, the heating conductor 2 is bent to a meander shape. The method of fixing to the support plate 1 is that the heating conductor 2 by means of a meander bend 4 in each case always grips the said plate in the region of the edge indentations 3.

As FIGS. 1 and 2 show, the helix formed by the heating conductor 2 is not uniformly wound; neighbouring turns are offset in a direction perpendicular to the plane of the support plate 1, i.e. upwardly in relation to the support plate 1 (upper turn 5*a*) and downwardly (lower turn 5*b*) respectively. Consequently the turns 5*a* and 5*b* extend above and below the support plate through different cross-sectional regions i.e., while indentations 3 are of equal depth and the support plate 1 forms chords of equal length relative to the turns, since the chords are not diametric, the heights of adjacent turns, relative to the plane of the support plate, are different. For the case where a support which is cross-shaped in transverse cross-section is used, there is indicated in broken lines in FIG. 2 a vertical support plate 1*a* which has edge indentations 3*a* of different depth corresponding to the course of the turns 5*a* and 5*b*.

In the illustrated constructional example the offsetting of the turns has the result that the turn centres 6*a*, 6*b* of the upper and lower turns 5*a*, 5*b* respectively are situated at a similar spacing above (+a) and below (−a) the support plate 1 respectively. The turns 5*a* or 5*b* of similar centre position have the same turn cross-section; and in fact this is true of all the turns in the illustrated, symmetrical, constructional example. Thus there are two turn groups, in which the turn centres 6*a*, 6*b* are situated periodically alternately above and below the support plate 1. In FIG. 1 it is indicated how the connecting lines 7*a*, 7*b* of the upper and lower turn centres 6*a*, 6*b* respectively extend parallel to the support plate 1.

In the constructional example of FIG. 4 a plurality of groups of turns, specifically four groups, are provided, whose turn centres (not shown) are again situated symmetrically above and below the support plate 1. A substantially identical cross-section of turn for all the turns is made possible by arranging that the edge indentations 3' for the outer turns 5' (whose turn centres are spaced further from the support plate 1) are more deeply indented than the edge indentations 3'' for the inner turns 5''. Thus, while all of the turns are of equal diameter, the indentations of different depth allow the turns to be shifted to different predetermined positions which are offset perpendicularly relative to the plane of the support plate.

FIG. 5 shows in diagrammatically simplified form a side view of another constructional form of heating device comprising two turn groups 5*a* and 5*b*. Here, the turn centres 6*a*, 6*b* (see FIG. 2) of the turns of each turn group converge in the direction towards the support plate 1, as shown by means of the inclined connecting lines 7*a*, 7*b*. Consequently the turns are radially staggered above and below the support plate 1 and uniformly distributed in a region of the maximum breadth b (measured in the longitudinal central plane of the heating device).

FIG. 6 shows a further constructional form wherein the turn centres 6*a*, 6*b* (see FIG. 2) are also arranged in converging manner. But here, contrary to the constructional example in FIG. 5, the turn cross-section varies in the longitudinal direction, so that between the tips 8 of the turns of the two turn groups there is a constant spacing d.

What is claimed is:

1. An electrical heating device for fluid media, comprising a heating conductor of resistance wire and a support plate having edges provided with indentations in which said conductor is located, the heating conductor being formed as a helical coil having a plurality of turns, arranged about the support plate with spacing, neighbouring turns of the coil being offset relatively to one another in a direction perpendicular to the plane of the support plate, and wherein the turns are arranged with a central point of each turn situated in one of a plurality of different predetermined positions, and each turn being engaged with a respective pair of said support plate indentations, the indentations of the pair being of equal depth and located on opposite edges of said support plate.

2. An electrical heating device according to claim 1, wherein those of the turns which have the same central point situation have substantially the same turn cross-section.

3. An electrical heating device according to claim 1, wherein the positions of the turn central points vary in a periodic manner along the length of the coil helix.

4. An electrical heating device according to claim 1, wherein the central points of the turns are situated alternately above and a support plate below the support plate.

5. An electrical heating device according to claim 1, wherein the support plate has edge indentations of different depths in which are located those of the turns which have their central points at different spacing from the support plate.

6. An electrical heating device according to claim 1, wherein the turns are arranged in turn groups and the central points of the turns of the respective groups converge toward the support plate along the length of the coil helix.

7. An electrical heating device according to claim 1, wherein the turns are arranged with tips thereof at a constant spacing between the tips of the turns of the different turn groups.

8. An electrical heating device according to claim 1, wherein the turns are arranged with tips thereof on lines which converge toward the support plate along the length of the coil helix.

9. An electrical heating device according to claim 1, wherein the resistance wire is bent into loops such that the heating conductor is of meander form, and the support plate in the region of the edge indentations engages in each case in one of said loops.

10. An electrical heating device for fluid media, comprising a heating conductor of resistance wire and a support plate having edges with indentations for supportively holding said conductor, said heating conductor being a coil having a plurality of turns wound about said support plate with a spacing between said turns and said support plate, wherein neighboring turns are offset with respect to each other in a direction normal to said support plate, and wherein said turns of said conductor include a plurality of turns arranged eccentrically disposed with respect to said support plate in a manner causing their centers to be located alternately above and below said support plate, each of said turns being engaged with a respective pair of said support plate indentations, the indentations of the pair being of equal depth and located on opposite edges of said support plate.

11. An electrical heating device according to claim 10, wherein those of said centers located above said support plate and those of said centers located below said support plate are equally spaced therefrom.

12. An electrical heating device according to claim 10, wherein all of the turns are of equal diameter.

13. An electrical heating device according to claim 10, wherein chords of the turns formed by said support plate are equal and the heights of adjacent turns relative to the plane of the support plate are different.

14. An electrical heating device according to claim 10, wherein said helical coil is supported by only one support plate.

* * * * *